US008240181B2

(12) United States Patent
Tsai et al.

(10) Patent No.: US 8,240,181 B2
(45) Date of Patent: Aug. 14, 2012

(54) EXTRUSION DIE DEVICE

(75) Inventors: Ping-Hsun Tsai, Taichung (TW); Chih-Peng Hsu, Tainan County (TW); Wan-Chi Chang, Changhua County (TW)

(73) Assignee: Metal Industries Research & Development Centre, Kaohsiung (TW)

( * ) Notice: Subject to any disclaimer, the term of this patent is extended or adjusted under 35 U.S.C. 154(b) by 488 days.

(21) Appl. No.: 12/613,240

(22) Filed: Nov. 5, 2009

(65) Prior Publication Data

US 2010/0132430 A1 Jun. 3, 2010

(30) Foreign Application Priority Data

Dec. 3, 2008 (TW) ..... 97146983 A

(51) Int. Cl.
*B21C 25/04* (2006.01)
*B21C 31/00* (2006.01)

(52) U.S. Cl. ..... 72/269; 72/467; 29/447

(58) Field of Classification Search ..... 72/253.1, 72/254, 260, 264, 267, 269, 271, 468; 76/4, 76/107.1, 107.4; 29/447
See application file for complete search history.

(56) References Cited

U.S. PATENT DOCUMENTS

| | | | | | |
|---|---|---|---|---|---|
| 2,276,468 | A | * | 3/1942 | Couchman | 72/269 |
| 2,368,355 | A | * | 1/1945 | Guiney | 72/269 |
| 3,748,885 | A | * | 7/1973 | Creuzet | 72/269 |
| 3,777,544 | A | * | 12/1973 | Alexandrov et al. | 72/269 |
| 3,834,209 | A | * | 9/1974 | Robertson | 72/269 |
| 4,350,865 | A | | 9/1982 | Bachrach | |
| 4,413,968 | A | | 11/1983 | Bliss | |
| 4,976,130 | A | * | 12/1990 | Oki et al. | 72/269 |
| 5,061,163 | A | * | 10/1991 | Kennedy | 72/269 |
| 5,571,235 | A | * | 11/1996 | Yano | 72/269 |
| 5,974,850 | A | * | 11/1999 | Huang et al. | 72/271 |
| 6,533,973 | B1 | | 3/2003 | Franke et al. | |
| 6,591,654 | B2 | * | 7/2003 | Kwok | 72/269 |

* cited by examiner

*Primary Examiner* — David B Jones
(74) *Attorney, Agent, or Firm* — Muncy, Geissler, Olds & Lowe, PLLC

(57) ABSTRACT

An extrusion die device includes a first die having a shaping hole. An inner periphery of the shaping hole has a plurality of twisted guiding portions. A second die includes a plurality of guiding holes. A bridge is formed between two adjacent guiding holes. A plurality of tongues extends from a surface of each bridge and each includes an input end face contiguous to the bridge and an output end face whose projection on the surface of the bridge has an angular shift relative to the input end face. A side of the second die is coupled to an input side of the first die. The tongues are received in the shaping hole. Material is squeezed through a passage between each tongue and the inner periphery of the shaping hole and rotates according to the twisting direction of the tongues, forming a hollow object with an integrally formed helical rib.

13 Claims, 9 Drawing Sheets

EXTRUSION DIE DEVICE

BACKGROUND OF THE INVENTION

1. Field of the Invention

The present invention relates to an extrusion die device and, more particularly, to an extrusion die device for forming a hollow object with an integrally formed helical rib by one-time extrusion.

2. Description of the Related Art

Extrusion includes applying pressure to force a heated metal material to pass through a shaping hole of a die, obtaining a produce having a hollow object or a solid rod. Metal tubes in rehabilitation devices or sport devices have specific requirements in strength. In an example shown in FIG. 1, the metal tube 1 includes a central rib 11 to enhance the bending strength. The metal tube 1 has uniform cross sections, and the central rib 11 provides enhanced strength of the metal tube 1 in the extending direction of the central rib 11. However, the structural strength of the other portions of the metal tube 1 not supported by the central rib 11 may be insufficient. The wall thickness of the metal tube 1 or the central rib 11 can be increased to enhance the structural strength of these portions, but the costs and the weight of the metal tube 1 are both increased.

Formation of helical rods or helical tubes by extrusion is known. Furthermore, helical fins can be formed on an outer periphery of a hollow object by extrusion. However, formation of a hollow object with an integrally formed central helical rib by one-time extrusion utilizing conventional die devices without changing the wall thickness of the hollow object or the central helical rib for providing the hollow object with uniform structural strength in the radial direction is still difficult.

SUMMARY OF THE INVENTION

The primary objective of the present invention is to provide an extrusion die device for forming a hollow object having an integrally formed helical rib to possess uniform strength in the radial direction.

Another objective of the present invention is to provide an extrusion die device for forming a hollow object having an integrally formed helical rib by one-time extrusion.

A further objective of the present invention is to provide an extrusion die device for forming a hollow object with less material and reduced costs.

An extrusion die device according to the preferred teachings of the present invention includes a first die having input and output sides. The first die further includes a shaping hole extending from the input side through the output side. A second die includes a central axis and first and second sides spaced along the central axis. The second die further includes a plurality of guiding holes each extending from the first side to the second side. A plurality of bridges each is formed between two of the guiding holes adjacent to each other and extends from an inner periphery of the second die to the central axis for the bridges to meet each other. A plurality of tongues each includes an input end face contiguous to one of the bridges and an output end face. A projection of the output end face of each tongue on the surface of one of the bridges where the input end face disposed has a first angular shift relative to the input end face of the tongue. The second side of the second die is coupled to the input side of the first die. The tongues are received in the shaping hole. A passage is formed between each tongue and an inner periphery of the shaping hole.

In use, material is squeezed through the passage between each tongue and the inner periphery of the shaping hole and rotates according to the twisting direction of the tongues, forming a hollow object with an integrally formed helical rib possessing uniform structural strength in the radial direction.

Preferably, the shaping hole is a conical hole tapering from the input side toward the output side of the first die.

Preferably, the shaping hole includes a central axis, with the input and output sides of the first die spaced along the central axis of the shaping hole, with the inner periphery of the shaping hole having a plurality of guiding portions, with two of the guiding portions adjacent to each other having an adjoining portion extending along an axis not intersecting the central axis of the shaping hole.

Preferably, each guiding portion includes an input end edge on the input side of the first die and an output end edge on the output side of the first die. A projection of the input end edge of each guiding portion on the output side has a second angular shift relative to the output end edge of the guiding portion.

Preferably, a position where the bridges meet includes a recessed portion between two of the tongues adjacent to each other.

Preferably, the central axis of the first die is coaxial with the central axis of the second die.

Preferably, each of the bridges includes first and second surfaces spaced along the central axis of the second die, and the second die further includes a splitting section having a first end contiguous to the first surface of the bridges in a position where the bridges meet and a second end adapted for splitting flow of metal material into the plurality of guiding holes.

Preferably, the splitting section has decreasing cross sectional areas from the first end toward the second end of the splitting section.

Preferably, directions of the first angular shift and the second angular shift are the same.

Preferably, a shape of the output end face of each tongue is a shape of each channel of a hollow object to be formed by the extrusion die device. Preferably, a container including a compartment is further comprised, wherein the compartment has two open ends, with one of the two open ends aligned and in communication with the guiding holes of the second die.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
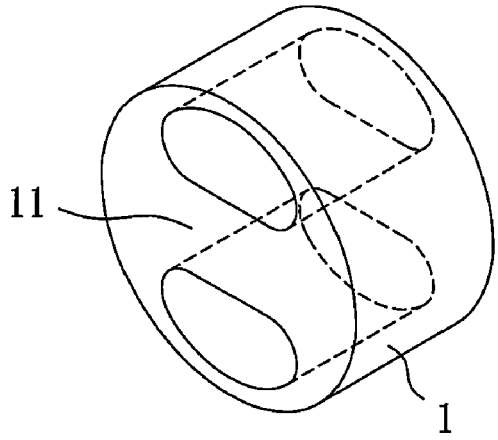
FIG. 1 shows a conventional metal tube with a central rib formed by conventional extrusion.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "end", "portion", "section", "radial", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

An extrusion die device according to the preferred teachings of the present invention is shown in the drawings. According to the preferred form shown, the extrusion die device includes a first die 3 and a second die 4. The first die 3 includes input and output sides 31 and 32. A shaping hole 33 extends from the input side 31 through the output side 32 of the first die 3 and includes an input end 34 in the input side 31 and an output end 35 in the output side 32. The input and output sides 31 and 32 of the first die 3 are spaced along a central axis of the shaping hole 33. In the most preferred form shown, the input end 34 is larger than the output end 35. Specifically, the shaping hole 33 is a conical hole tapering from the input side 31 toward the output side 32 of the first die 3. The shape of the output end 35 is circular so that the resultant hollow object formed by the extrusion die device is cylindrical. The shaping hole 33 further includes an inner periphery having a plurality of guiding portions 36 between the input end 34 and the output end 35. Two of the guiding portions 36 adjacent to each other have an adjoining portion 38 extending along an axis not intersecting the central axis of the shaping hole 33. Each guiding portion 36 includes an input end edge 362 on the input side 31 of the first die 3 and an output end edge 364 on the output side 32 of the first die 3. A projection of the input end edge 362 of each guiding portion 36 on the output side 32 has an angular shift relative to the output end edge 364 of the guiding portion 36. Namely, the guiding portions 36 are twisted in a direction about the central axis of the shaping hole 33.

In the preferred form shown, the second die 4 includes a central axis A coaxial with the central axis of the shaping hole 33. The second die 4 includes first and second sides 41 and 42 spaced along the central axis A. The second die 4 further includes a plurality of guiding holes 43 each extending from the first side 41 to the second side 42. A bridge 44 is formed between two of the guiding holes 43 adjacent to each other. Each bridge 44 extends from an inner periphery of the second die 4 to the central axis A and includes first and second surfaces 442 and 444 spaced along the central axis A, while the bridges 44 meet at the central axis A. A plurality of tongues 45 formed on the second surface 444 of each bridge 44 and extends away from the bridge 44, with the tongues 45 preferably being spaced out and close to the central axis A. Preferably, numbers of the guiding holes 43, bridges 44, and tongues 45 are the same. According to the most preferred form shown in FIG. 2, the second die 4 includes two guiding holes 43, two bridges 44, and two tongues 45. However, the number of the guiding holes 43 does not have to be related to the number of the tongues 43. Each tongue 45 includes an input end face 46 contiguous to the bridge 44 and an output end face 47. The bridge 44 includes two bulged portions 48 connecting with and corresponding to the input end faces 46 of the tongues 45, forming a recessed portion 49 between the bulged portion 48. The shape of the output end face 47 of each tongue 45 is the shape of each channel of the hollow object to be formed by the extrusion die device.

In the most preferred form shown, the tongues 45 encircle the central axis A of the second die 4 with identical distances to the said central axis A; that is, when the number of the tongues 45 is two, these two tongues 45 are symmetrically located on opposite sides of the central axis A. A projection of the output end face 47 of each tongue 45 on the second surface 444 of the bridge 44 has an angular shift relative to the input end face 46 of the tongue 45. The direction of the angular shift between the input and output end faces 46 and 47 of each tongue 45 can be the same or opposite to that of the angular shift between the input and output end edges 362 and 364 of the guiding portions 36.

In the most preferred form shown, the second die 4 further includes a substantially wedge-shaped splitting section 40 having a first end 401 contiguous to the first surface 442 of the bridge 44 and a second end 402. The splitting section 40 is disposed at the place where the bridges meet each other and has decreasing cross sectional areas from the first end 401 toward the second end 402 of the splitting section 40.

Figure 2:
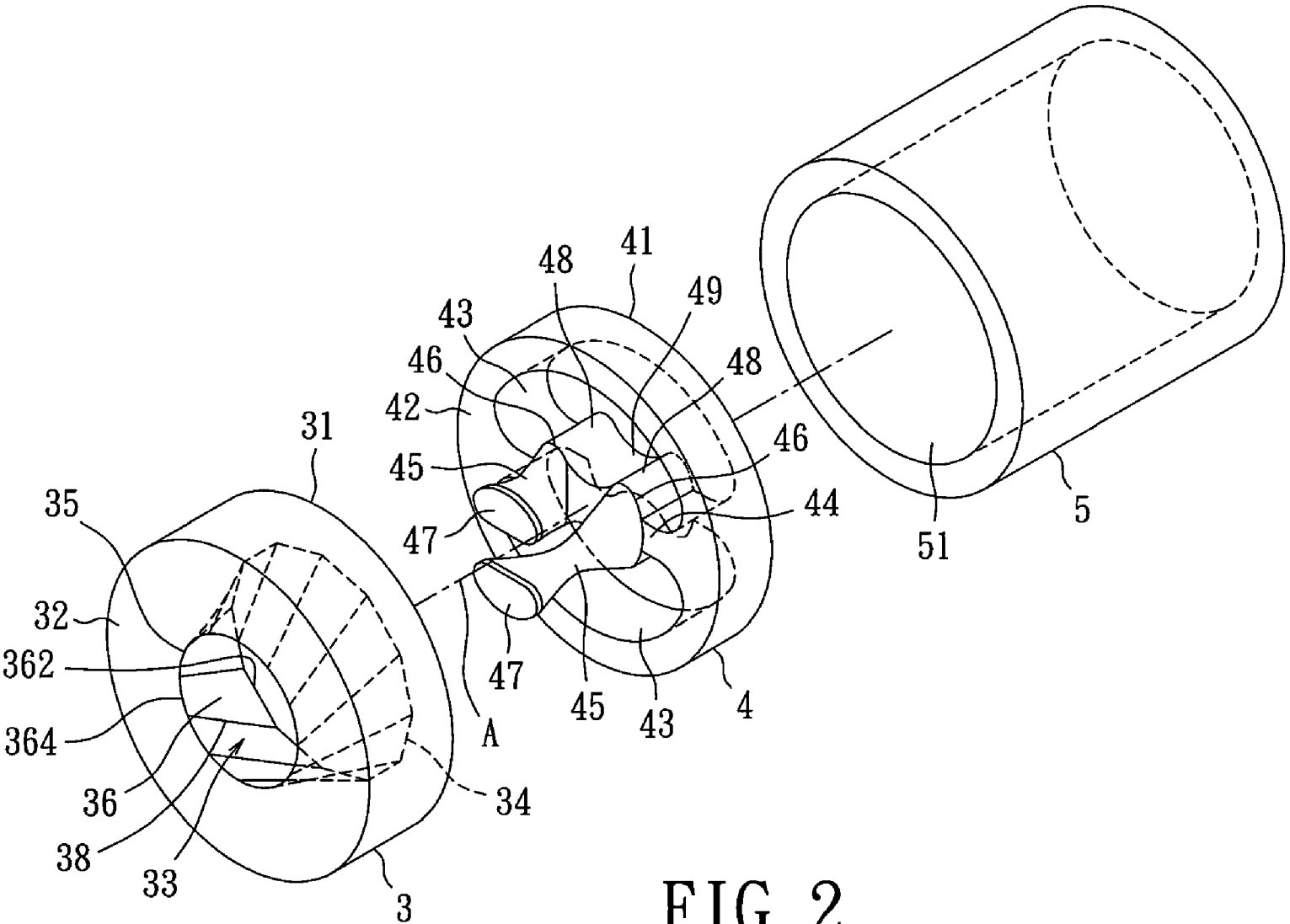
FIG. 2 shows an exploded, perspective view of an extrusion die device according to the preferred teachings of the present invention.
Figure 3:
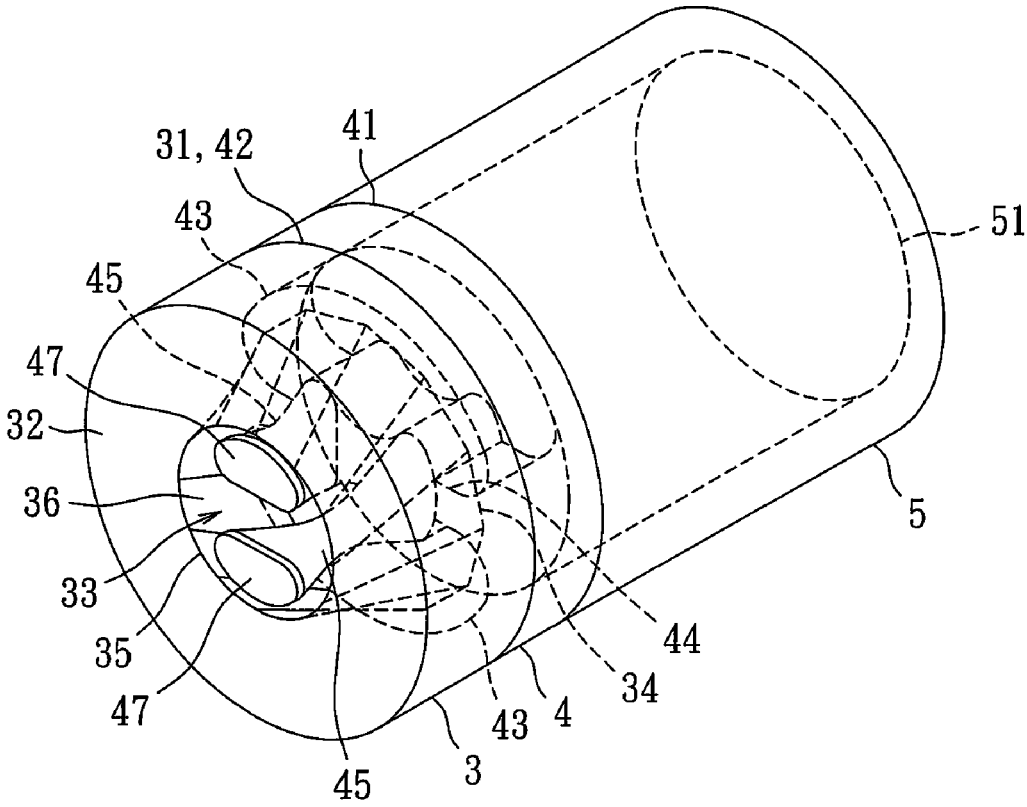
FIG. 3 shows a perspective view of the extrusion die device of FIG. 2.

Referring to FIGS. 2 and 3, in assembly, the second side 42 of the second die 4 is coupled to the input side 31 of the first die 3. The tongues 45 are received in the shaping hole 33 of the first die 3. A passage is formed between each tongue 45 and the inner periphery of the shaping hole 33. The output end face 47 of each tongue 45 is preferably flush with the output end 35 of the shaping hole 33. However, the output end face 47 of each tongue 45 does not have to be flush with the output end 35 of the shaping hole 33. Furthermore, the output end face 47 of each tongue 45 is spaced from a periphery of the output end 35 of the shaping hole 33. A container 5 containing metal material for forming the hollow object is coupled to the first side 41 of the second die 4. The container 5 includes a compartment 51 having two open ends. One of the open ends of the compartment 51 is aligned and in communication with the guiding holes 43 of the second die 4. The splitting section 40 of the second die 4 is located in the compartment 51 of the container 5. However, the splitting section 40 can be arranged outside of the compartment 51 of the container 5 if desired.

Figure 4:
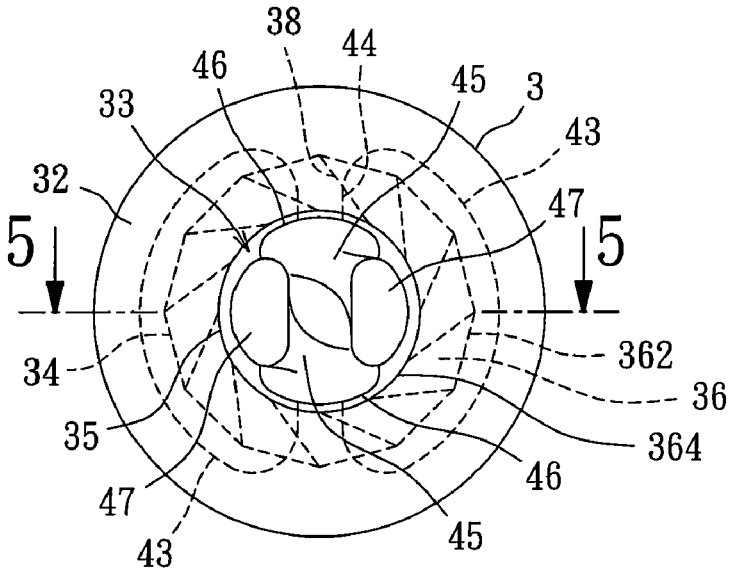
FIG. 4 shows a bottom view of the extrusion die device of FIG. 2.
Figure 5:
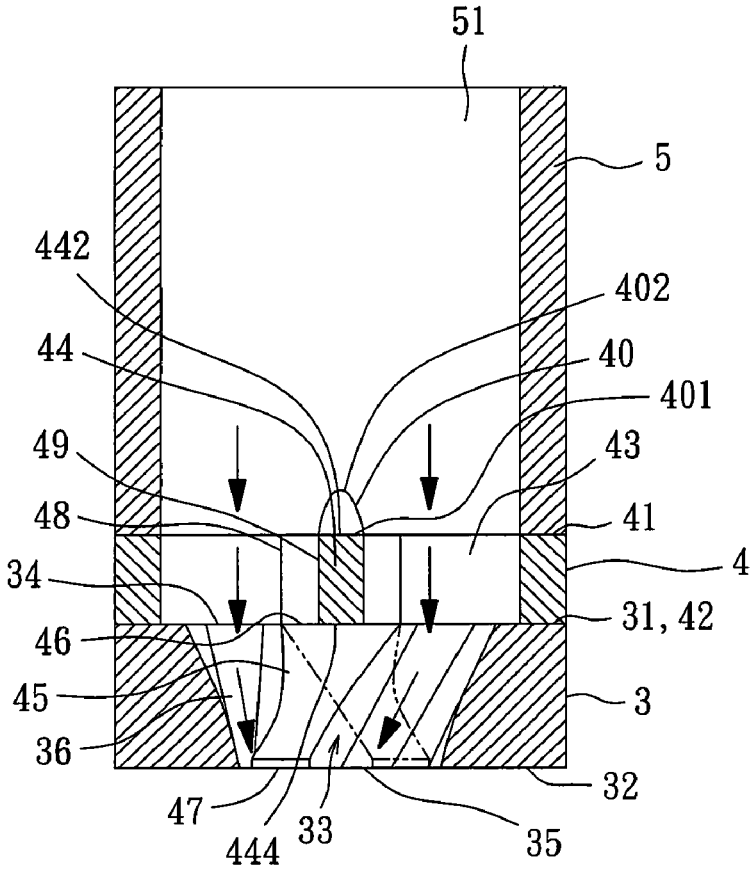
FIG. 5 shows a cross sectional of the extrusion die device of FIG. 2 taken along section line 5-5 of FIG. 4.

Referring to FIGS. 3 through 5, in forming a hollow object with a helical rib by the extrusion die device according to the preferred teachings of the present invention, the metal material is heated to be in a molten state and fed into the compartment 51 of the container 5. A rod is utilized to apply pressure to the molten metal material. Thus, the molten metal material is squeezed and moves toward the splitting section 40 of the second die 4. The flow of the molten metal material is guided by the splitting section 40 into the guiding holes 43 and branches into two streams of molten metal material after passing through the splitting section 40 and the bridge 44.

Due to provision of the recessed portion 49 of the bridge 44, the two streams of molten metal material are guided to the tongues 45 and rotate through an angle. Furthermore, the two streams of molten metal material merge under high temperature and high pressure. An interior portion of the merged flow of molten metal material twists along each tongue 45, and an exterior portion of the merged flow of molten metal flow twists along each guiding portion 36. Thus, the molten metal material is twisted while passing through and being guided by the guiding portions 36 of the first die 3 and the tongues 45 of the second die 4. Namely, during forming of the hollow object by extruding the molten metal material, the molten metal material is twisted and, thus, forms the hollow object 2 with an integrally formed helical rib 21 (FIG. 6) by one-time extrusion.

Figure 6:
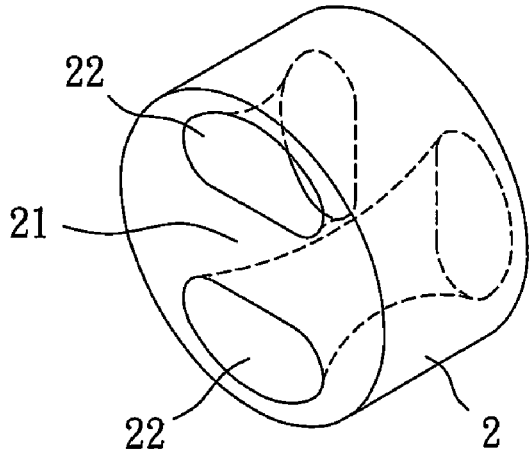
FIG. 6 shows a hollow object formed by the extrusion die device of FIG. 2.

As shown in FIG. 6, the hollow object 2 formed by the extrusion die device according to the preferred teachings of the present invention includes the helical rib 21 dividing the hollow object 2 into two channels 22. Each channel 22 is substantially helical and extends from one end through the other end of the hollow object 2 along the helical rib 21. Thus, the hollow object 2 with the integrally formed helical rib 21 formed by one-time extrusion possesses uniform structural strength in the radial direction without changing the wall thickness of the hollow object 2 or the helical rib 21, saving the material costs.

Figure 7:
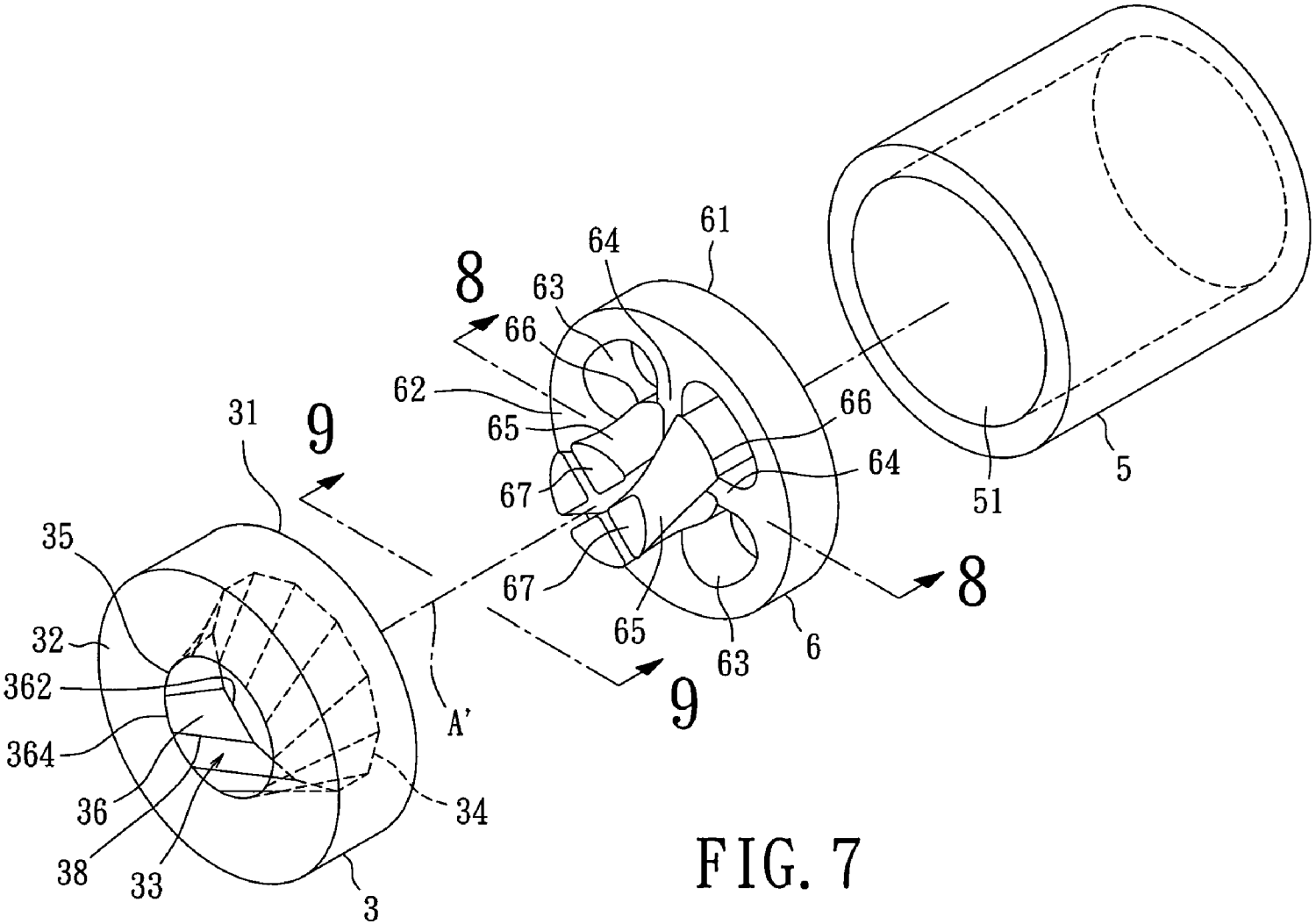
FIG. 7 shows an exploded, perspective view of an extrusion die device according to the preferred teachings of a specific embodiment of the present invention.

Referring to FIG. 7, an extrusion die device according to the preferred teachings of a specific embodiment of the present invention for illustration of alteration in guiding holes 43 and bridges 44 is shown. Specifically, a second die numbered as "6" is provided. The second die 6 includes a central axis A' coaxial with the central axis of the shaping hole 33, first and second sides 61 and 62 spaced along the central axis A', four guiding holes 63 each extending from the first side 61 to the second side 62, and four bridges 64 each formed between two of the guiding holes 63 adjacent to each other. Each bridge 64 extends from an inner periphery of the second die 6 to the central axis A' and has two opposite surfaces spaced along the central axis A' and respectively disposed at the first and second sides 61 and 62, while the four bridges 64 meet at the central axis A'. Four tongues 65 respectively extend from the surface of the four bridges 64, which is disposed on the second side 62, and away from the bridge 64. Preferably, the tongues 65 are spaced out and close to the central axis A'.

Figure 8:
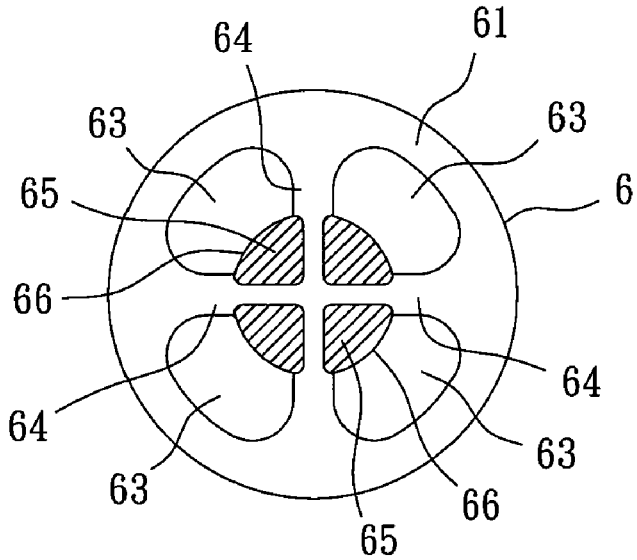
FIG. 8 shows a cross-sectional view of a second die of the extrusion die device according to section line 8-8 of FIG. 2.
Figure 9:
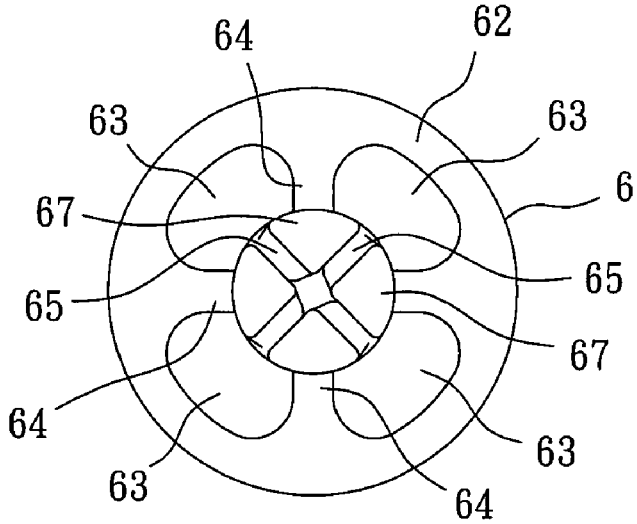
FIG. 9 shows a bottom view of the second die of the extrusion die device according to line 9-9 of FIG. 2.

Please refer to FIGS. 7 through 9 now. Each tongue 65 includes an input end face 66 contiguous to the bridge 64 and an output end face 67. Preferably, the four input end faces 66 encircle the central axis A' with an identical peripheral distance between any two input end faces 66 that are peripherally adjacent. The shape of the output end face 67 of each tongue 65 is the shape of each channel of the hollow object to be formed by the extrusion die device. A projection of the output end face 67 of each tongue 65 on the surface of the bridge 64, where the tongue 65 extends from, has an angular shift relative to the input end face 66 of the tongue 65, which can be observed through FIGS. 8 and 9. The direction of the angular shift between the input and output end faces 66 and 67 of each tongue 65 can be the same or opposite to that of the angular shift between the input and output end edges 362 and 364 of the guiding portions 36.

Figure 10:
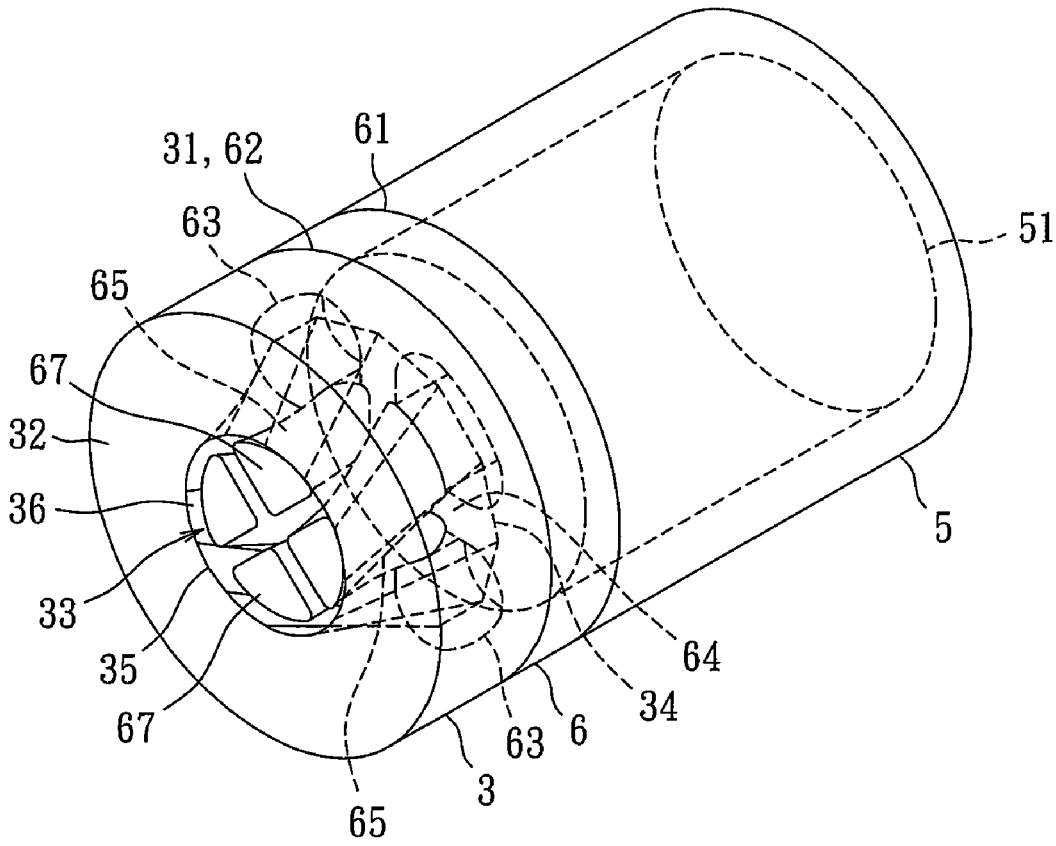
FIG. 10 shows a perspective view of the extrusion die device of FIG. 7.

Referring to FIGS. 7 and 10, in assembly, the second side 62 of the second die 6 is coupled to the input side 31 of the first die 3, with the tongues 65 received in the shaping hole 33 of the first die 3. A passage is formed between each tongue 65 and the inner periphery of the shaping hole 33. Thereby, in forming a hollow object with a helical rib by the extrusion die device according to the preferred teachings of the present invention, the metal material is heated to be in a molten state. When a flow of the molten metal material is guided into the guiding holes 63 and branches into four streams of molten metal material after passing by the bridge 64, the four streams of molten metal material are guided to rotate through an angle by the tongues 65. Furthermore, the four streams of molten metal material merge under high temperature and high pressure. An interior portion of the merged flow of molten metal material twists along each tongue 65, and an exterior portion of the merged flow of molten metal flow twists along each guiding portion 36. Thus, the molten metal material is twisted while passing through and being guided by the guiding portions 36 of the first die 3 and the tongues 65 of the second die 6. Namely, during forming of the hollow object by extruding the molten metal material, the molten metal material is twisted and, thus, forms a hollow object 7 with four integrally formed helical ribs 71 (FIG. 11) by one-time extrusion.

Figure 11:
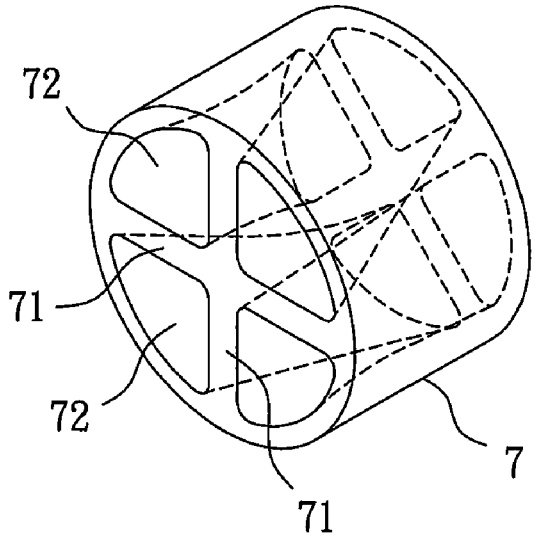
FIG. 11 shows a hollow object formed by the extrusion die device of FIG. 7.

As shown in FIG. 11, the hollow object 7 formed by the extrusion die device according to the preferred teachings of the specific embodiment of the present invention includes the helical ribs 71 dividing the hollow object 7 into four channels 72. Each channel 72 is substantially helical and extends from one end through the other end of the hollow object 7 along the helical ribs 71. Thus, the hollow object 7 with the integrally formed helical ribs 71 formed by one-time extrusion possess uniform structural strength in the radial direction without changing the wall thickness of the hollow object 7 or the helical ribs 71, saving the material costs.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. An extrusion die device comprising:

a first die including input and output sides, with the first die further including a shaping hole extending from the input side to the output side; and a second die including a central axis and first and second sides spaced along the central axis, with the second die further including a plurality of guiding holes each extending from the first side to the second side, a plurality of bridges each formed between two of the guiding holes adjacent to each other and extending from an inner periphery of the second die to the central axis for the bridges to meet each other, and a plurality of tongues each having an input end face contiguous to one of the bridges and an output end face, with a projection of the output end face of each of the tongues on the surface of one of the bridges where the input end face disposed having a first angular shift relative to the input end face of the tongue, wherein the second side of the second die is coupled to the input side of the first die, the plurality of tongues is received in the shaping hole, and a passage is formed between each of the tongues and an inner periphery of the shaping hole.

2. The extrusion die device as claimed in claim 1, wherein the shaping hole is a conical hole tapering from the input side toward the output side of the first die.

3. The extrusion die device as claimed in claim 2, wherein the shaping hole includes a central axis, with the input and output sides of the first die spaced along the central axis of the shaping hole, with the inner periphery of the shaping hole having a plurality of guiding portions, with two of the guiding portions adjacent to each other having an adjoining portion extending along an axis not intersecting the central axis of the shaping hole.

4. The extrusion die device as claimed in claim 3, wherein each of the guiding portions includes an input end edge on the input side of the first die and an output end edge on the output side of the first die, and a projection of the input end edge of each guiding portion on the output side has a second angular shift relative to the output end edge of the guiding portion.

5. The extrusion die device as claimed in claim 3, wherein the central axis of the shaping hole is coaxial with the central axis of the second die.

6. The extrusion die device as claimed in claim 5, wherein a position where the bridges meet includes a recessed portion between two of the tongues adjacent to each other.

7. The extrusion die device as claimed in claim 5, wherein each of the bridges includes first and second surfaces spaced along the central axis of the second die, and the second die further includes a splitting section having a first end contiguous to the first surfaces of the bridges in a position where the bridges meet and a second end adapted for splitting flow of metal material into the plurality of guiding holes.

8. The extrusion die device as claimed in claim 7, wherein the splitting section has decreasing cross sectional areas from the first end toward the second end of the splitting section.

9. The extrusion die device as claimed in claim 4, wherein directions of the first angular shift and the second angular shift are the same.

10. The extrusion die device as claimed in claim 1, wherein numbers of the guiding holes, bridges, and tongues are all two.

11. The extrusion die device as claimed in claim 1, wherein numbers of the guiding holes, bridges, and tongues are all four.

12. The extrusion die device as claimed in claim 1, wherein a shape of the output end face of each tongue is a shape of each channel of a hollow object to be formed by the extrusion die device.

13. The extrusion die device as claimed in claim 1 further comprising a container including a compartment, wherein the compartment has two open ends, with one of the two open ends aligned and in communication with the guiding holes of the second die.

* * * * *